US010337133B2

(12) United States Patent
Plata Amarillas et al.

(10) Patent No.: US 10,337,133 B2
(45) Date of Patent: Jul. 2, 2019

(54) WASHING MACHINE AND TEXTILE WASHING AND RINSING METHOD

(71) Applicant: MABE, S.A. DE C.V., Santiago de Queretaro (MX)

(72) Inventors: Santiago Alonso Plata Amarillas, Queretaro (MX); Erick Flores Islas, Queretaro (MX)

(73) Assignee: MABE, S.A. DE C.V., Queretaro (MX)

( * ) Notice: Subject to any disclaimer, the term of this patent is extended or adjusted under 35 U.S.C. 154(b) by 197 days.

(21) Appl. No.: 15/240,500

(22) Filed: Aug. 18, 2016

(65) Prior Publication Data

US 2016/0355966 A1 Dec. 8, 2016

Related U.S. Application Data

(62) Division of application No. 12/052,052, filed on Mar. 20, 2008, now abandoned.

(30) Foreign Application Priority Data

Mar. 22, 2007 (MX) ..... MX/A/2007/003397

(51) Int. Cl.
*D06F 35/00* (2006.01)
*D06F 33/02* (2006.01)
(Continued)

(52) U.S. Cl.
CPC ..... *D06F 33/02* (2013.01); *D06F 35/005* (2013.01); *D06F 35/006* (2013.01); *D06F 37/12* (2013.01);
(Continued)

(58) Field of Classification Search
CPC ..... D06F 33/00; D06F 35/005; D06F 35/006; D06F 37/12; D06F 39/083; D06F 39/087;
(Continued)

(56) References Cited

U.S. PATENT DOCUMENTS 3,088,305 A 5/1963 Ohmann
3,663,975 A 5/1972 Fish et al.
(Continued)

FOREIGN PATENT DOCUMENTS

CA 2182167 1/1997
DE 2752214 6/1979
(Continued)

*Primary Examiner* — David G Cormier

(74) *Attorney, Agent, or Firm* — Terry M. Sanks, Esq.; Beusse Wolter Sanks & Maire, PLLC

(57) ABSTRACT

A textile rinsing method in a washing machine, the washing machine including a tub, a rotating basket within the tub and a water spraying device, the method comprising stopping the basket, admitting a predetermined fresh water quantity, storing the predetermined fresh water quantity in the tub, spraying the textiles by means of the water spraying device, draining and centrifuging the remaining liquid in the tub and determining the number of semi-rinses. The method may be carried out in a washing machine including a tub and a rotating basket within the tub, wherein the washing machine comprises a pumping system, and a set of spraying means, including a directional valve, a conduction hose, a tub cover and, be it a hose with a plurality of holes or a nozzle and deflector or dispenser box, wherein by means of the directional valve, the pumping system is capable of leading through the conduction hose a determined quantity of fresh water stored in the tub to the, be it a hose with a plurality of holes or a nozzle and deflector or dispenser box, wherein any of the afore are capable of directing the water towards the basket.

19 Claims, 10 Drawing Sheets

(51) Int. Cl.
*D06F 39/02* (2006.01)
*D06F 37/12* (2006.01)
*D06F 39/08* (2006.01)

(52) U.S. Cl.
CPC ..... *D06F 39/02* (2013.01); *D06F 39/087* (2013.01); *D06F 39/088* (2013.01); *D06F 2232/06* (2013.01)

(58) Field of Classification Search
CPC ..... D06F 39/088; D06F 2202/00; D06F 2202/06; D06F 2202/065; D06F 2202/08; D06F 2202/12; D06F 2204/00; D06F 2204/06; D06F 2204/065; D06F 2204/08; D06F 2204/082; D06F 2232/06
See application file for complete search history.

(56) References Cited

U.S. PATENT DOCUMENTS 4,168,615 A 9/1979 Condit
4,175,409 A 11/1979 Morey
4,225,992 A 10/1980 Morey
4,502,303 A 3/1985 Wasemann
4,561,471 A 12/1985 Diaz
4,754,622 A 7/1988 Fanson
5,167,722 A 12/1992 Pastryk et al.
5,199,127 A * 4/1993 Van Newenhizen ..... D06F 35/006 8/158
5,361,439 A 11/1994 Malchow
5,469,719 A 11/1995 Imai et al.
5,504,955 A 4/1996 Mueller et al.
5,507,053 A 4/1996 Mueller et al.
5,582,039 A 12/1996 Mueller et al.
5,606,877 A 3/1997 Hashimoto
5,692,259 A 12/1997 Lee et al.
5,737,790 A 4/1998 Badger et al.
5,743,115 A 4/1998 Hashimoto
6,125,490 A 10/2000 Riechman et al.
6,151,742 A 11/2000 Dausch et al.
6,212,722 B1 4/2001 Pinkowski et al.
6,351,974 B1 3/2002 Lyu et al.
6,516,484 B2 2/2003 Kwon
6,668,410 B2 12/2003 Lyu et al.
7,017,217 B2 3/2006 Johanski et al.
7,146,669 B2 12/2006 Orszulik
7,263,862 B2 9/2007 Lyu et al.
7,263,864 B2 9/2007 Lyu et al.
2005/0028298 A1 2/2005 Kim et al.
2005/0071930 A1 4/2005 Bruntz
2005/0274156 A1 12/2005 Yang
2007/0084000 A1 4/2007 Bernardino et al.

FOREIGN PATENT DOCUMENTS

EP 0394657 10/1990
GB 2317620 1/1998

* cited by examiner

WASHING MACHINE AND TEXTILE WASHING AND RINSING METHOD

CROSS-REFERENCE TO RELATED APPLICATIONS

This application is a Division of U.S. application Ser. No. 12/052,052 filed Mar. 20, 2008, which claims priority from Mexican Application No. MX/a/2007/003397 filed Mar. 22, 2007, and incorporated herein by reference in their entirety.

FIELD OF THE INVENTION

The present invention refers to washing machines and textile washing methods, particularly textile rinsing methods in a washing machine, which avoids water waste, improves textile rinsing effect and obtains less textile wear.

BACKGROUND OF THE INVENTION

The present invention provides a washing machine and an improved textile rinsing method in washing machines.

The rinsing methods known in prior art are carried out by deep rinse methods or by spray methods or combination of the same.

In a deep rinse phase, water is admitted in a tub to predetermined levels. The textiles are agitated in the fresh water by an agitator or propeller, and the water is later drained and the textiles centrifuged.

In a spray rinse phase, the basket is rotated at a constant determined speed, while fresh water is admitted and sprayed to the textiles, which adhere against the base and walls of the basket due to the basket's rotation. Fresh water penetrates the textile's layers, taking away a certain amount of detergent and filth of the textile being washed. The remaining liquid is continuously drained. The phase is usually completed by means of rotating the basket at a high speed, in which case a large part of the remaining water in the textiles is extracted by centrifuge force. Since agitation during spray rinse is eliminated, and since there is almost no friction between the agitator and the textiles during spray rinse, the wear of textiles is reduced.

Textile rinse methods in washing machines by means of spraying are known. For example, U.S. Pat. No. 5,167,722 discloses a method for rinsing a textile wash load for use in a vertical axis washing machine in which a plurality of initial spray rinses are used in which the released water is discharged directly to drain and a plurality of subsequent spray rinses are used in which the water is re-circulated through the spinning clothes load for a predetermined length of time before being discharged to drain. Enhanced detergent and soil removal with less water usage is achieved with this method. However, in the method disclosed by the patent, water is sprayed while rotating the basket, therefore an entire removal of detergent and soil is not achieved. In the above-mentioned patent, the basket is rotated at high speeds, while water is re-circulated and sprayed. To achieve the effects of the above patent, spray means have be operated at the same time as drain means. Therefore, spraying means have to be directed directly to the clothes.

In the present invention the spray means and drain means are not operated at the same time, since fresh water may be stored in the tub, to be later sprayed to the clothes while the basket is still.

U.S. Pat. No. 5,504,955 discloses a method of rinsing in an automatic washer having an imperforate wash tub, a perforate wash basket disposed within the tub and rotatable about a vertical axis and a bottom plate disposed within the lower portion of the wash basket and mounted for wobbling motion. The method of rinsing includes adding rinse liquid into the wash basket and re-circulating the rinse liquid over the clothes items while driving the bottom plate in a mutating movement. Mutating movement describes the movement of the bottom plate wherein the bottom plate is slowly rotated within the wash basket while being driven in a rapid wobbling motion. In this fashion, the clothes are repeatedly moved under a spray pattern of rinse liquid while being jostled and flexed for achieving the desired excellent detergent and soil removal during rinse. In a second embodiment, the step of slowly rotating the wash basket for moving the clothes under a spray pattern of rinse liquid is combined with a step of wobbling the bottom plate for agitating the clothes while spraying rinse liquid onto the clothes items. The patent discloses a method using a propeller, which is different to the effect produced by an agitator. Additionally, in the method disclosed by the patent, water is sprayed while rotating the basket. Therefore, an entire removal of detergent and soil is not achieved. The patent discloses a basket rotation at low speed while re-circulating and spraying fresh water.

U.S. Pat. No. 5,692,259 discloses a rinsing method for a washing machine, which can prevent the waste of the washing liquid and can improve the rinsing effect. The rinsing method has the steps of introducing the washing liquid into an outer tub, spinning a spin tub such that the washing liquid contained in the clothing is discharged into a sump area, repeatedly spraying the washing liquid into the spin tub by circulating the washing liquid collected in the sump area, and draining the washing liquid collected in the sump area out of the washing machine. The rinsing method repeats the steps at least one time. Since the washing liquid is sprayed toward an upper wall of the spin tub, impurities formed between the outer tub and the spin tub are effectively removed. By the rinsing method, the washing liquid can be saved and the rinsing effect can be improved. In the method disclosed by the patent, water is sprayed while rotating the basket. Therefore, an entire removal of detergent and soil is not achieved. Furthermore, the machine sprays fresh water to the clothes, however, does not centrifuge the clothes to free the cloth of the water within. Additionally, the machine in the above-mentioned patent collects water while rotating the basket.

In the present invention, the basket is stopped while collecting and spraying fresh water. The invention of the above-mentioned patent dehydrates the cloth while spraying fresh water due to the constant rotation of the basket. Furthermore, the invention of the above-mentioned patent recycles water that is filtered during spraying. This has proven to be ineffective, since water which contains detergent and filth is being recycled.

U.S. Pat. No. 5,737,790 discloses a laundry washing machine in which water is conserved by replacing the conventional deep rinse by a series of spray rinses. Each spray rinse utilizes a predetermined quantity of water which is sprayed directly at the clothes load while the load is rotated, thereby allowing the rinse water to pass straight through the clothes load, and removing soil and/or detergent from the clothes. The amount of water used in each spray rinse is determined from a first "sense rinse" cycle in which the volume of water required to totally saturate the clothes load is found. In each subsequent rinse, a proportion (preferably from about 50% to about 100%) of this value is used. In the method disclosed by the patent, water is sprayed while rotating the basket. The foregoing technique does not achieve a complete removal of detergent and filth in the textiles.

One of the differences between the present invention, with the above mentioned US patent is that said patent contains devices to control the rinse centrifuge duration means. It has been observed that controlling time and water depending on the amount of clothing, does not achieve an efficient removal of detergent and dirt in the cloths. On the contrary, surprisingly a constant quantity of water and time, without depending on the quantity of clothes, achieves a better removal of detergent and filth in the rinsing phase. Therefore, the rinsing time cycles or blocks are constant in the present invention. The water used in the semi-rinse blocks are constant patterns in the present invention. That is, the present invention does not refer to an adaptive method in the water quantity used in the semi-rinse blocks in function of the cloth load as the above-mentioned US patent does, rather to constant methods with certain predetermined water variation patterns in each semi-rinse block previously determined by the user and control.

U.S. Pat. No. 5,743,115 discloses a washing machine having a rinse mode for rinsing laundry placed in a tub of the washing machine. Rinse mode control means controls water supply to the tub and rotation of the tub to carry out a spin dry rinse mode. The spin dry rinse mode includes a first operation during which water is supplied into the tub while the tub is rotated and a second operation during which the supply oft water is stopped and the tub is rotated. The washing machine further includes means for detecting the amount of laundry put into the tub. A rinse time change means controls the time for spin dry rinse mode in accordance with the amount of laundry detected. Thus, time can be saved and water conserved while still effectively rinsing the laundry.

One of the differences of the present invention with the above-mentioned US patent, is that the above-mentioned US patent contains devices to control the rinse-centrifuge duration means. It has been observed that controlling time and water depending on the amount of cloth does not achieve an efficient removal of detergent and filth in the cloth. On the contrary, surprisingly a constant quantity of water and time, without depending on the quantity of clothes, achieves a better removal of detergent and filth in the rinsing phase. Therefore, the rinsing time cycles or blocks are constant in the present invention. The water used in the semi-rinse blocks are constant patterns in the present invention. That is, the present invention does not refer to an adaptive method in the water quantity used in the semi-rinse blocks in function of the cloth load as the above-mentioned US patent does, rather to constant methods. A further difference between the present invention and the above US patent, is that the present invention achieves a better removal of detergent and filth with the basket still while spraying. The above US patent is rotating the basket while spraying.

U.S. Pat. No. 6,516,484 discloses method of rinsing laundries in a washing machine with a tilted washing tub consisting of an outer tub and an inner tub is disclosed. In the method of this invention, a predetermined amount of water is primarily fed to the washing tub while constantly rotating the inner tub at an initial speed of no higher than a predetermined rpm, with the amount of water being predetermined in accordance with the weight of the laundries to be rinsed within the washing tub. Thereafter, a circulation-rinsing step is performed. In this step, the laundries are rinsed while rotating the inner tub at a second speed, with the water repeatedly circulated from the washing tub to a nozzle provided at the upper portion of the washing tub through a water circulation hose, and sprayed under pressure from the nozzle into the washing tub. These steps are repeated a predetermined number of times. As in the other prior art disclosed, the patent discloses how to spray water while rotating the basket, and therefore, does not achieve a complete removal of detergent and filth in the cloth. The patent discloses a method using a propeller, which is different to the effect of using an agitator.

In U.S. Pat. No. 7,017,217 an apparatus and method to operate a washing machine are disclosed, in which a rinse cycle is provided for a washing machine including a rotatable basket and a fresh water spraying device. The method comprises rotating the basket at a first rate of rotation, spraying water into the basket while the basket is rotating at the first rate, and rotating the basket at a second rate of rotation, the second rate of rotation greater than the first rate of rotation. As in the other prior art disclosed, the patent discloses how to spray water while rotating the basket, and therefore, does not achieve a complete removal of detergent and filth in the cloth.

U.S. Pat. No. 7,146,669 discloses method of rinsing a wash load in a washing machine having a perforated drum which is rotatable about an axis and capable of receiving the wash load and having a water inlet which is capable of introducing water to the interior of the rotatable drum includes the steps of rotating the drum about the axis at a first rotational speed sufficient to retain the wash load stationary with respect to the rotating drum; introducing rinse water into the interior of the rotating drum via the inlet so that the rinse water is sprayed from the inlet onto the wash load, the volume of rinse water so introduced being less than the volume required to saturate the wash load; and increasing the speed of rotation of the drum to a second rotational speed sufficient to spin a significant proportion of the rinse water out of the wash load. Also, said patent discloses spraying the cloth while rotating the basket.

The above mentioned prior art, uses spray rinse phases. In certain prior art, the combination of spray and deep rinse phases is used. An example of the above is U.S. Pat. Nos. 5,167,722 and 5,737,790. However, when using the combination of rinses, said patents obtained the disadvantage of requiring high quantities of water, and therefore an efficient reduction of used water by the washing machine was not obtained.

Additionally, determining the quantity of water to be used in the rinse has been disclosed in the art. For example, EP patent No. 0 394 657 discloses a washing machine with multiple rinses, in which each phase and water level during each rinse, is determined by the prior rinse phase to decrement the total duration of the washing phase.

Rotating the basket while spraying the cloth, as is disclosed by prior art, causes a dehydration of the cloth. The present invention does not achieve in the spraying phase the dehydration of the textiles. Even more, the present invention does not intend to achieve a dehydration during spraying, rather the adequate hydration of the textiles. The greater the rotation speed the basket has, the more centrifuge force is created in the textiles, and thus, the greater dehydration is achieved in the textiles. Even with a low rotation speed, a certain centrifuge force is done, causing the dehydration of the cloth. Since in the present invention the basket is still during the spraying of fresh water, the textiles are not dehydrated.

Furthermore, the present invention varies the fresh water quantity in a constant manner, that is, it has a predetermined diminishing, raise, or equal fresh water pattern in each semi-rinse block or cycle, the present invention does not vary in an adaptive manner the quantity of water of each semi-rinse block, that is, it does not adapt the quantity of fresh water in each semi-rinse block as a function of the cloth quantity to be rinsed.

BRIEF DESCRIPTION OF THE INVENTION

After agitation in the washing phase, the liquid in which the cloth was washed is drained and the textiles are centrifuged to extract detergent and carry out the filth in said textiles. The draining and centrifuge may be carried out in a parallel manner, or liquid draining may be previously done and centrifuge the textiles at a later time, while draining the liquid. In view of the basket rotation, a centrifuge force is created, adhering the textiles to the basket wall, compacting the textiles and thus reducing volume. The centrifuge force and volume reduction of textiles dehydrate the textiles.

In the rinsing phase, a predetermined quantity of fresh water is admitted in the tub, e.g. between the tub and basket. The fresh water is later pumped from the bottom of the tub and driven to the tub cover, which in a preferred embodiment may contain a hose with perforations in its perimeter, to spray water to textiles in the basket. So that the textiles are uniformly soaked and water saturated, the spraying of fresh water is carried out when the basket is still. The water is sprayed with force by means of a hose with perforations to the textiles. Ending the spraying, the remaining liquid is drained and the textiles centrifuged. The draining and centrifuge may be carried out in a parallel manner, or draining may start previously and centrifuge in a later time while draining. Therefore, a first semi-rinse block is achieved. Generally, at least two semi-rinse blocks are carried out.

Optionally, in the rinse phase, a predetermined quantity of fresh water is admitted in the tub, e.g. between the tub and the basket. Fresh water is pumped from the bottom of the tub and driven to the tub cover, which contains deflector means to spray water to the textiles. Softeners and detergents may be dispatched during different stages of the rinse phase by means of a dispatcher, located in the upper part of the washing machine, to be guided to the bottom of the tub, without having contact with the cloth, combining with the previously admitted fresh water, creating a rinse liquid. So that the textiles are uniformly soaked and water saturated, the spraying of fresh water is carried out when the basket is still by means of a nozzle and the deflector which emit the rinse liquid or fresh water towards the textiles. Later the basket is rotated by angles or predetermined positions, stopping the basket in each angle or predetermined position, and spraying again the textiles with fresh water or rinse liquid in each angle or predetermined position. Once the rotation by angles or predetermined positions of the basket have ended, the remaining liquid is drained and the textiles are centrifuged in parallel, or draining previously and later centrifuging while draining. In the afore-mentioned steps a first semi-rinse block has been achieved. Generally, at least two semi-rinse blocks are carried out.

Optionally, in a rinse phase, a predetermined quantity of fresh water is admitted in the tub, preferably between the tub and basket. Fresh water is pumped from the bottom of the tub and driven to the tub cover, which contains a dispatcher box to spray water to the textiles. So that the textiles are uniformly soaked and water saturated, the spraying of fresh water is carried out when the basket is still by means of the dispatcher box which emits the fresh water with force. Softeners and detergents may be dispatched by means of the dispatcher box, in different moments of the rinse phase. Later, the basket is rotated by angles or predetermined positions, stopping the basket in each angle or predetermined position, and spraying again the textiles with fresh water or rinse liquid in each angle or predetermined position. Once the rotation by angles or predetermined positions of the basket have ended, the remaining liquid is drained and the textiles are centrifuged in parallel, or draining previously and later centrifuging while draining. In the afore-mentioned steps a first semi-rinse block has been achieved. Generally, at least two semi-rinse blocks are carried out.

Different to prior art, which achieves textile dehydration by the constant basket rotation, the present invention, since during the spraying step the basket is motionless (still) a textile hydration is carried out without basket rotation. In the three example embodiments the basket is motionless. Since the basket is motionless, an improved fresh water saturation is achieved in the external layers of the textiles, and thus, diluting and carrying filth is achieved in a uniform manner. An improved water saturation is achieved when the basket is still, since the fresh water accumulates in the external layers of the textiles. The external layers are those that are exposed to the water being sprayed. Once the external layer is saturated considerably diminishing the detergent and filth concentration in a uniform manner in said layer, the penetration of fresh water to the internal layers is not allowed. When the basket is rotated to centrifuge the textiles, the fresh water in the external layer of the textiles goes through the internal layer of the textiles which is not exposed to the spraying, until reaching the external periphery of the basket. Since the basket is perforated, the fresh water penetrates the basket and is deposited on the tub.

The centrifuge time is a predetermined set time since the quantity of fresh water used in each semi-rinse block is constant by means of patters, or constant in each block. A constant quantity of fresh water, be it a diminishing or raising quantity, or simply the same amount of water in each semi-block, achieves a better removal of detergent and water in each textile rinse. It is not an object of the invention to vary the quantity of water in function to the quantity of textiles being washed, that is, it is not an object of the invention to vary water quantity in an adaptive manner.

The prior art does not achieve a significant saving of the water used. The prior art is not focused on maximizing the water saving as is the present invention. The present invention focuses on maximizing water saving for each textile load level, achieving the required and expected rinse performance by the user.

The centrifuge step in the washing phase or rinse phase, as well as any of the embodiments, may be carried out in different manners. For example, when the basket is still at zero velocity to a maximum velocity in a constant ascending manner; or a null velocity constantly increasing the velocity with descending peaks, that is in a gradually ascending manner; or a null velocity increased in a progressive manner until reaching a first rotation rate speed, holding the first rotation speed and increasing again in a progressive manner until reaching a second rotation rate speed. It is not an object of the invention the manner in which a centrifuge stage is started in a washing machine.

However, it is an object of the invention providing a spray rinse method with textile hydration, that achieves an important water saving, with respect to spray and deep rinse methods disclosed by the art.

It is a further object of the invention providing a spray rinse method combined with a deep rinse method, that achieves an important energy saving with respect to spray and deep rinse methods disclosed by the art.

Another object of the invention is providing a textile rinse that achieves an adequate detergent and filth removal of the textiles, diminishing the wear and tear of the same, compared to traditional rinse methods.

A further object of the invention is providing a textile hydration method in a rinse phase, by means of fresh water saturation in said textiles. Therefore, a further object of the invention is stopping the basket during fresh water spray to the textiles.

Another object of the invention, is providing a method which uses a constant water pattern in each one of the semi-rinse blocks.

Additionally, another object of the invention is providing a washing machine that may achieve the afore-mentioned objects by means of different configurations in the washing machine.

Other objects and advantages of the invention will become apparent when taking into account the specification in regards to the following figures.

BRIEF DESCRIPTION OF THE FIGURES

The particular features and advantages of the invention, as well as other objects of the invention, will be clear from the following specification, taking into account the following figures, from which.

DETAILED DESCRIPTION OF THE INVENTION

Figure 1:
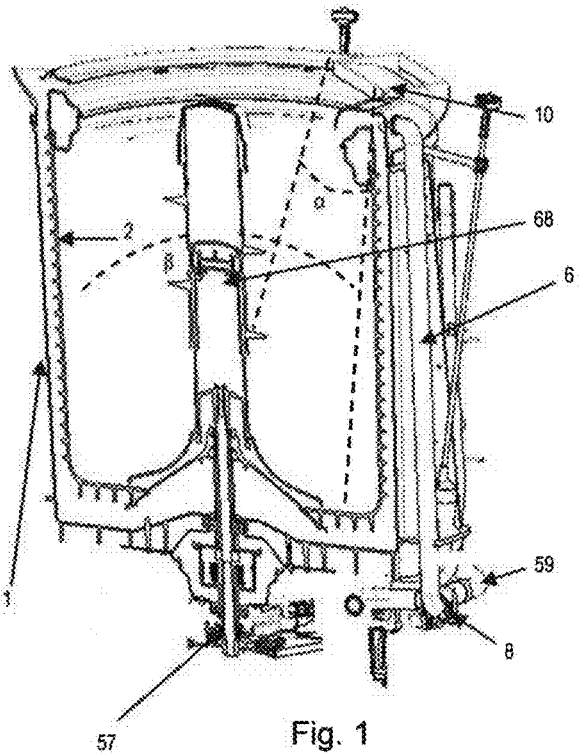
FIG. 1 is a conventional perspective view of a transversal cut of the washing machine of the invention.
Figure 2:
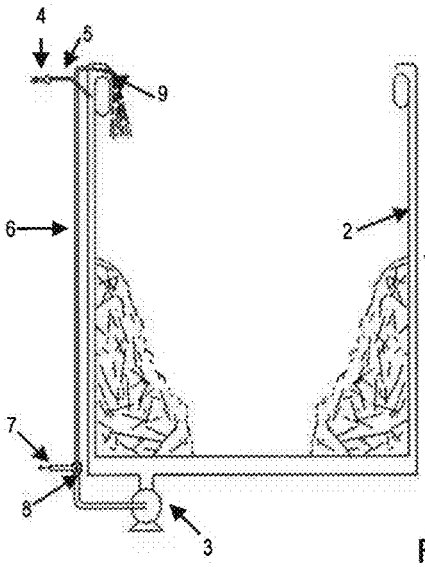
FIG. 2 is a transversal cut of the tub and basket of the washing machine of the present invention.

FIGS. 1 and 2 show a transversal cut of the tub (1) and basket (2) of the washing machine of the present invention. The washing machine of the invention, contains fresh water admission valves (4), wherein fresh water is deposited at the bottom of the tub for washing phase and rinse phase by means of a hose (5). The fresh water admission valves (4), where the water may be hot or cold, allow the fresh water to enter between the basket (2) and the tub (1) through the hoses (5), and deposit and store the fresh water at the bottom of the tub (1). Preferably, the fresh water must be admitted between the tub (1) and the basket (2) to avoid contacting directly the textiles.

The washing machine of the invention may contain an agitator or propeller (68), to agitate the textiles during a washing phase. The agitator or propeller (68) is driven by a driving system (57), said driving system (57) may include a motor, pulleys, bands and shafts among others. Additionally, the washing machine has a draining hose (59), to drain remaining liquid. Within the tub (1), the washing machine has a basket (2), which rotates and centrifuges the textiles during appropriate moments in the washing and rinse phases.

The washing machine has a directional valve (8), which is actuated and shifted by an actuator, such as a thermo-actuator, during appropriate moments of the washing and rinse phases. The actuator allows the directional valve (8) to shift the flow of liquid towards the drain (7) by means of the draining hose (59), or the conduction of fresh water to the basket (2) by means of a conduction hose (6) and a pumping system (3).

The pumping system (3), as well as the driving system (57), is mounted below the tub (1) and is activated during various appropriate moments in the washing and rinse phases, for example: when draining liquid in the tub (1) to the drain (7) by means of the draining hose (59), when indexing in the rinse and centrifuging the basket (2). Depending on the directional valve (8) position, the pumping system is also active during the rinse phase to lead fresh water through the conduction hose (6) towards the tub cover (56). The motor, the driving system (57) and the pumping system (3) below the stationary tub (1), may be partially observed in FIGS. 1 and 3.

The motor and drive system (57) are mounted below the stationary tub (1), to rotate the basket (2) and agitator or propeller (68) relative to each other.

The conduction hose (6) leads fresh water to the holed hose (69) in the tub cover (56), to spray the textiles in the basket (2). Optionally, the conduction hose leads fresh water to a nozzle (9) and deflector (10) in the tub cover (56) to spray the textiles in the basket (2). Optionally, the conduction hose (6) leads fresh water to a dispenser box (71) in the tub cover (56), to spray the textiles in the basket (2). The dispenser box (71) will be explained with greater detail in regards to FIGS. 6 and 7.

The washing machines, typically include a cabinet (61) that house the tub (1). The basket (2) is found within the tub (1) and is centered with regards to the tub (1). The basket (2) is perforated to allow fluid communication between the basket (2) interior and the washing tub (1). The basket (2) holds the textiles to be washed, and hoses the agitator or propeller (68), which is centered with regards to the basket (2).

Additionally, the washing machine may include a brake assembly (not shown), which may be an electromagnetic brake, which selectively stops the rotation of the basket (2).

The washing machine detects different water levels in the tub (1) by means of a pressure sensor (58), that is preferably a presostate. However, it is possible to avoid the use of a pressure sensor (58) in all the embodiments, since it is possible to know an approximate water quantity within the tub (1) by means of a flow sensor (76) which may be a flow meter. The pressure sensor (58) measures water quantity existing in the tub (1). The flow sensor (76) measures the water quantity entering through the admission valves (4).

The textile load and effectiveness of the phases to use, depends upon the textiles to be washed, the load of the same, etc., data which is previously determined by the user. The machine operation may be controlled by an electronic control (55), to select the phases and the features of each washing cycle. The electronic control (55) may be an electronic card, with micro and memory.

In the preferred embodiment of the invention, the pumping system (3) by means of the directional valve (8), is capable of leading through the conduction hose (6) the fresh water stored in the tub to a hose (69) found in the tub cover (56). Said hose (69) has along its periphery a plurality of holes, wherein said hose (69) is capable of dispensing detergents or chlorines or softeners and is capable of combining fresh water with the detergents or chlorines or softeners. The hose (69) by means of its holes, is capable of directing rinse liquid or fresh water towards the textiles in the basket (2) with a force subject to the pressure of the pumping system (3).

The pumping system (3), directional valve (8), conduction hose (6), tub cover (56) and hose (69) with holes, make a set of spraying means. The method to carry out the preferred embodiment will be explained with greater detail below.

In a first washing machine embodiment, the pumping system (3) is capable, by means of the directional valve (8), of leading through conduction hoses (6) the fresh water stored in the tub (1) towards a nozzle (9). The fresh water or rinse liquid, when emanating from the nozzle (9) hits against a deflector (10). The deflector (10) or nozzle (9) is capable of dispensing detergents or chlorines or softeners. The deflector (10) is capable of directing the rinse liquid or fresh water towards the textiles in the basket (2) with a force subject to the pressure of the pumping system (3).

The pumping system (3), directional valve (8), conduction hose (6), tub cover (56), the nozzle (9) and the deflector (10), make a set of spraying means. The method to carry out the first embodiment will be explained with greater detail below.

In a second washing machine embodiment, the pumping system (3) is capable, by means of the directional valve (8), of leading through conduction hoses (6) the fresh water stored in the tub (1) towards a dispenser box (71) wherein the dispenser box (71) is capable of combining the fresh water with detergents or chlorines or softeners. Additionally, the dispenser box (71) is capable of directing the rinse liquid or fresh water towards the textiles in the basket (2) with a force subject to the pressure of the pumping system (3).

The pumping system (3), directional valve (8), conduction hose (6), tub cover (56), and the dispenser box (71), make a set of spraying means. The method to carry out the second embodiment will be explained with greater detail below.

Figure 3:
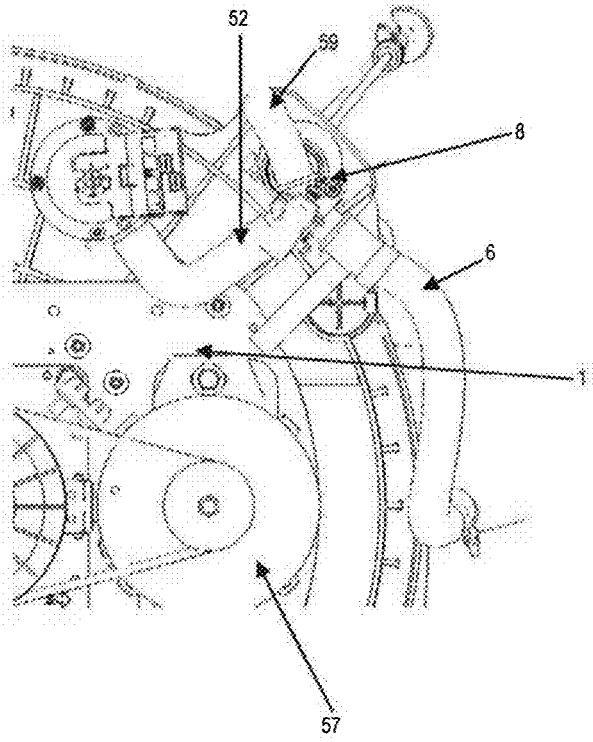
FIG. 3 is a detailed inferior view of the washing machine of the present invention, specifically of a directional valve.

FIG. 3 is a detailed view of the directional valve (8) used in the invention. In the figure, the tub (1) may be seen by its lower part, as well as the motor and drive system (57) partially. The directional valve (8) is connected to the hose (52) of liquid outlet or fresh water coming from the tub (1), to the conduction hose (6) that will eventually lead to the holed hose (69) or the nozzle (9) and deflector (10) or the dispenser box (71) and the drain hose (59) that connects the washing machine to the drain (7). An actuator (not shown) shifts the state of the directional valve (8).

Figure 4:
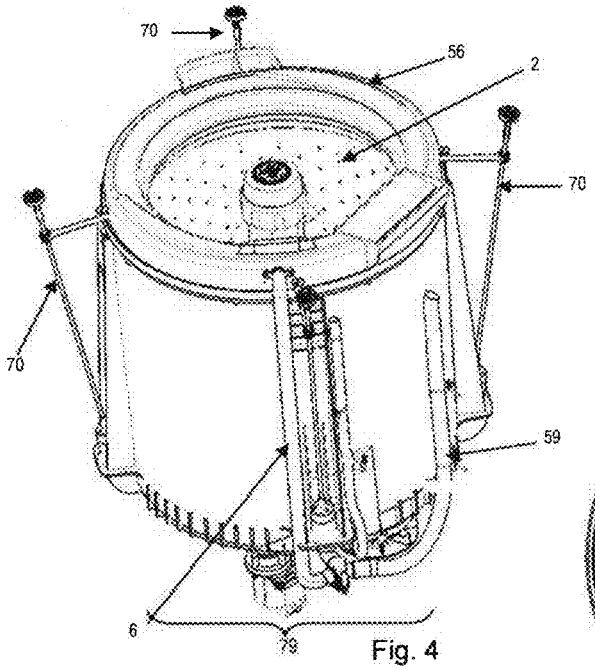
FIG. 4 is an upper conventional perspective view of the washing machine of the present invention.

FIG. 4 shows an upper conventional perspective view of the tub (1), the perforated basket (2), the conduction hose (6), the drain hose (59), as well as the tub cover (56). The tub (1), the basket (2), the drive means (54), the motor, the agitator (68) and other parts that conform the sub-washing machine (79), that is, all the components that are fixed to the tub (1), are fixed to the cabinet (61) by means of suspension rods (70).

Figure 5:
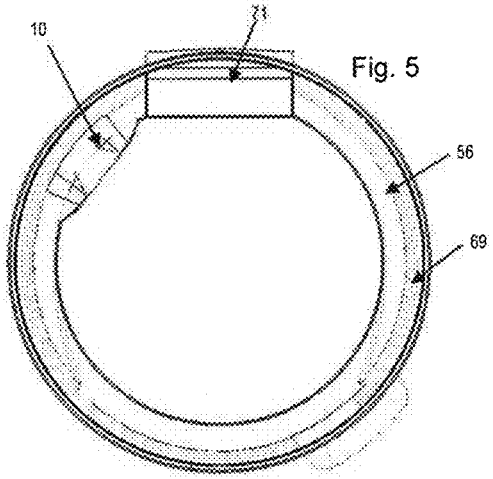
FIG. 5 is a lower view of the washing machine tub cover of the present invention.

FIG. 5 is a lower view of the tub cover (56).

In the preferred embodiment of the washing machine, the tub cover (56) contains an internal hose (69) which has the same circumference than the tub cover (56). Throughout said hose (69) a plurality of holes are provided. While spraying in the rinse phase, the pumping system (3) provides sufficient water pressure, so that the hose (69) is filled with water, spraying the textiles within the basket (2) by said plurality of holes.

In a first embodiment of the washing machine, the tub cover (56) contains the deflector (10) and houses the nozzle (9). While spraying in the rinse phase, the pumping system (3) provides sufficient water pressure, so that the nozzle (9) emits the water, and said water crashes against the deflector (10), spraying the textiles within the basket (2).

In a second embodiment of the washing machine, the tub cover (56) contains the dispenser box (71). While spraying in the rinse phase, the pumping system (3) provides sufficient water pressure, so that the dispenser box (71) emits the water, spraying the textiles within the basket (2).

Figure 6:
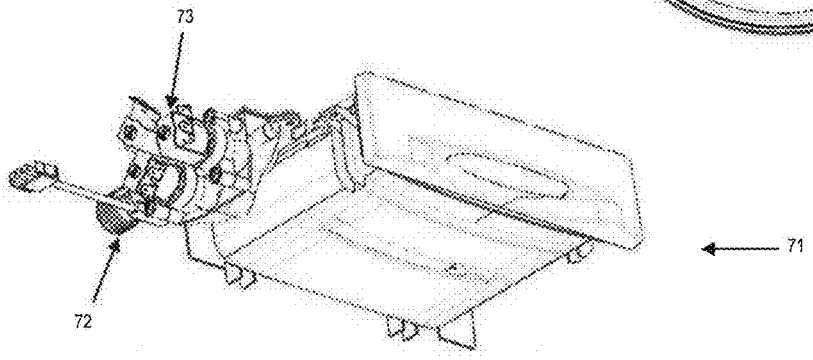
FIG. 6 is a lower conventional perspective view of a dispenser box used by the present invention.

The dispenser box (71) of the invention may be observed with greater detail in FIG. 6. The dispenser box (71) includes at least one water entry (72), as well as a series of electrical connections (73) to receive and send signals from the electronic control (55) to determine when to start and finish receiving and emitting water during the spraying phase.

Figure 7:
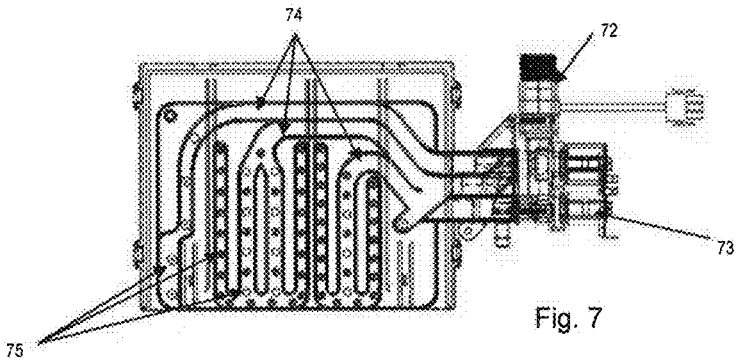
FIG. 7 is an upper transversal cut view of a dispenser box of the present invention.

In FIG. 7, the internal part of the dispenser box (71) may be observed. The dispenser box (71) contains a plurality of ducts (74) which will lead the fresh water to be sprayed later. Throughout the ducts (74) detergents or softeners or chlorines may be kept, which are mixed throughout the dispenser box (71) ducts (74) with fresh water. The resulting liquid or the fresh water, is dispensed by a plurality of holes (75) in the dispenser box towards the textiles in the basket (2).

Figure 8:
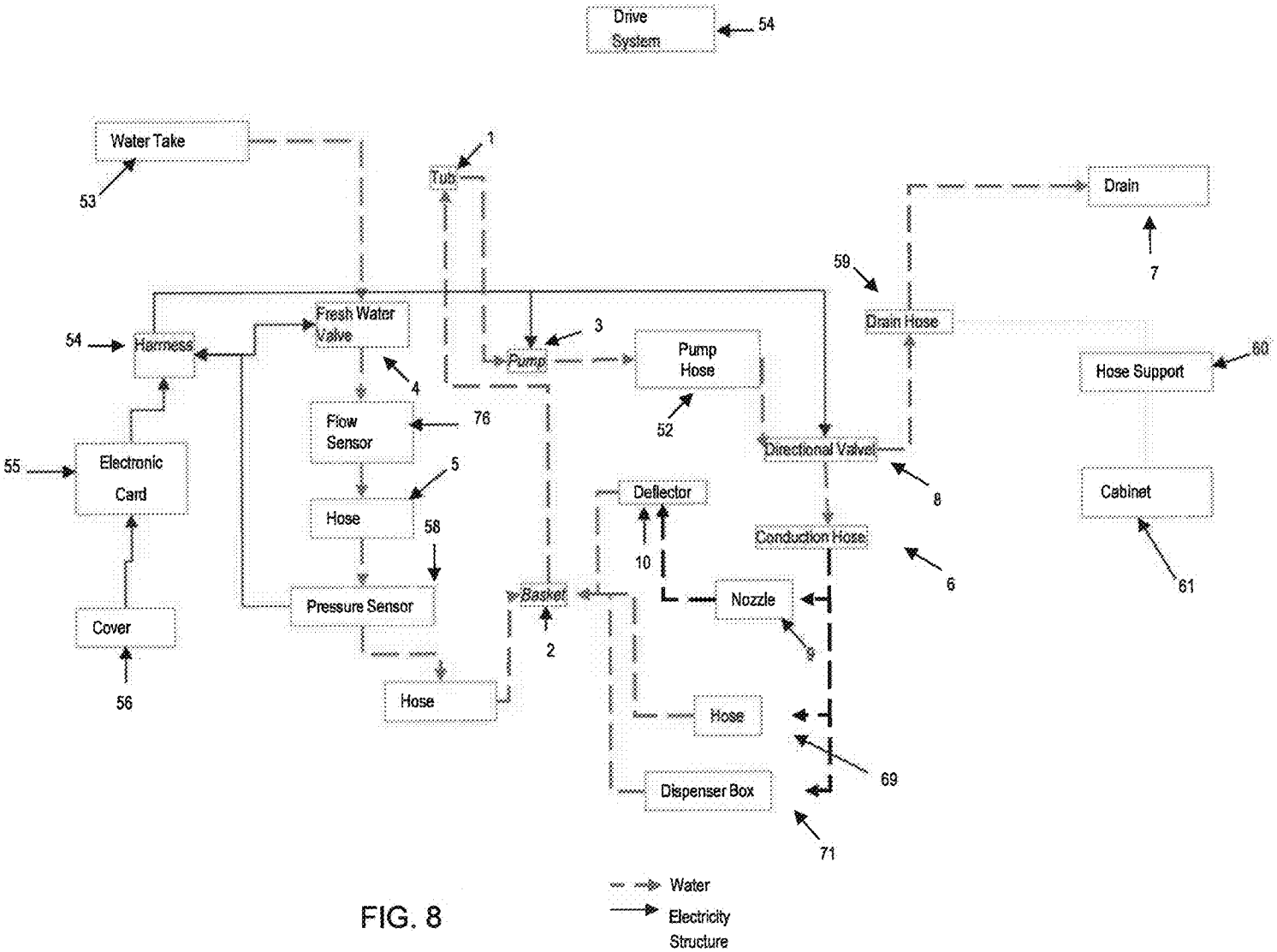
FIG. 8 is a part relation diagram of the washing machine of the present invention.

FIG. 8 shows a relation diagram of each of the washing machine parts.

The water entry (53) is found connected to the fresh water admission valve (4), allowing fresh water admission. The flow sensor (76) measures the volume of incoming fresh water between the tub (1) and the basket (2) by means of said admission valves (4). At the same time, the water admission valves (4) are connected to the hose (5) that leads fresh water between the tub (1) and the basket (2). The hose (5) is subject to the harness (54) of the washing machine.

The pressure sensor (58) is capable of sensing the accumulated and stored fresh water volume in the tub (1).

The basket (2) is found within the tub (1) and said tub (1), houses in its lower part the pump (3) and the drive system (54). The pump hose (52) is connected to the directional valve (8), and the directional valve (8) is connected to the drain hose (59) that final leads to the drain (7), as well as the conduction hose (6).

The end of the conduction hose (6), the hose (69) with a plurality of holes in the tub cover (56) may be found, whose product is sprayed over the textiles within the basket (2).

Optionally, at the end of the conduction hose (6), the nozzle (9) may be found, whose emission crashes with the deflector (10) and whose product is sprayed over the textiles within the basket (2).

Optionally, at the end of the conduction hose (6), the dispenser box (71) may be found, whose product is sprayed over the textiles within the basket (2).

The tub cover (56) may preferably house the pressure sensor (58), the flow sensor (76), the control panel, the harness (54), the knobs and the electronic control. The tub cover (56) and its components, are supported by the washing machine harness (54). The drain hose (59) is supported (60) by the washing machine cabinet (61).

Figure 9:
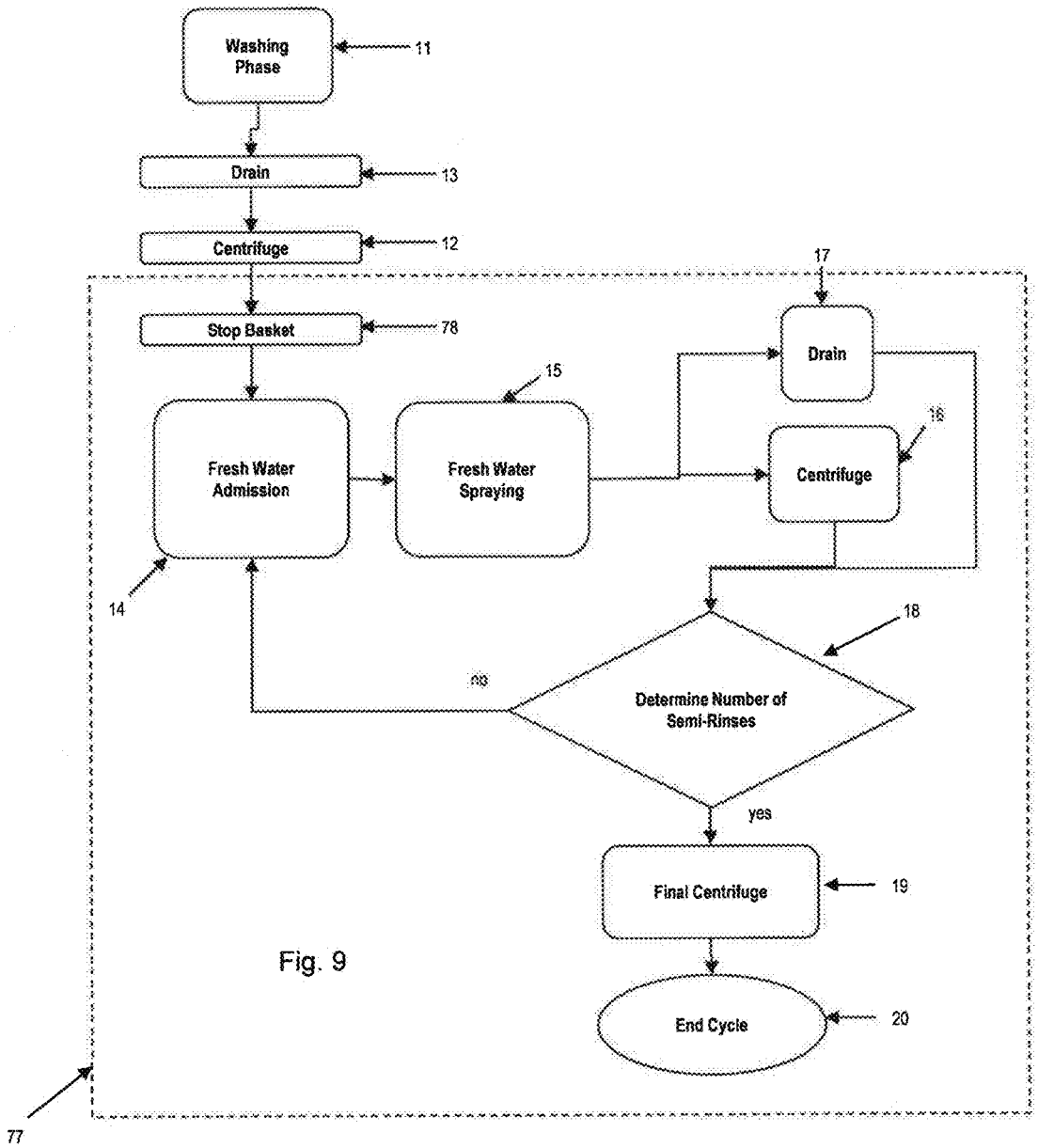
FIG. 9 is a flow diagram of the preferred embodiment of the rinse phase of the present invention.

FIG. 9 shows a flow diagram of the preferred embodiment of the rinse phase. In an illustrative manner of the washing phase (11), the textiles are put in the basket (2) and the washing operation is started by the manipulation of the control entry selectors and time mechanisms. The tub (1) is filled with water and mixed with detergents to form a washing liquid and the textiles are agitated with the agitator or propeller (68) for their cleaning. After a determined agitation time, the tub (1) is drained with the pump system (3), the directional valve (8), the drain hose (59) and the drain (7).

According to the preferred embodiment of the rinse phase (77), having finished the washing phase (11), the textiles are centrifuged (12) within the basket (2), causing said textiles to adhere to the basket (2) wall, and consequently to compact the volume of said textiles, causing the dehydration of the same. The liquid penetrates the interior layers of the textiles towards the basket (2) wall, depositing said water in the tub (1) by means of the perforations of said basket (2).

During and at the end of centrifuging (12), the remaining liquid sumped in the cloth and tub (1) are drained.

Finishing centrifuging (12) and draining (13), the basket (2) is stopped (78). The basket (2) may be stopped by means of a brake or by decrementing the inertia of the same. The directional valve (8) is activated closing the way to draining (13) and opening way to the conduction hose (6). Fresh water is admitted (14) between the tub (1) and the basket (2) by means of the hose (5). The fresh water which is admitted (14) to the tub is sprayed (15) by a set of spraying means.

The set of spraying means in the preferred rinse embodiment, is preferably formed by a pumping system (3), a directional valve (8), a conduction hose (6), the tub cover (56) and the hose (69) with holes.

In the preferred rinse embodiment, the tub cover (56) contains an internal hose (69) which contains a plurality of holes. The hose (69) has the same diameter as the tub cover (56). Once the fresh water is admitted (14) and the basket (2) is stopped, fresh water is sprayed by means of the set of spraying means described above, wherein the pressure pump (3) provides sufficient fresh water pressure, so that the fresh water goes up the conduction hose (6) filling the hose (69) entirely and the textiles are sprayed by means of the hose (69) with a plurality of holes. The spraying is carried out in a uniform manner and saturates in an appropriate manner the exterior layer of the textiles within the basket (2).

The exterior layer of textiles, is that layer that is found immediately exposed to the spraying of fresh water, whilst the interior layer of textiles, is that which is found proximate to the external periphery of the basket (2).

The fact that the basket (2) is still while spraying fresh water, conveys advantages, among them, the proper hydration of the textiles during spraying. This allows a better saturation of fresh water in the textiles, causing a better and uniform detergent dilution and drag of filth.

When the spraying time has been completed, the directional valve (8) is activated to drain (17) the remaining liquid in the tub (1) and centrifuge (16) the textiles within the basket (2). The draining (17) and centrifuge (16) may be done simultaneously, or in separate times, however preferably draining (17) is started first and then centrifuge (16). However, draining (17) must be constantly done during centrifuging (16). Optionally, during centrifuge (16), draining (17) may be interrupted in certain periods. These periods are determined time intervals during which a certain quantity of liquid is gathered at the bottom of the tub (1).

The fresh water sprayed to the textile exterior layer, which has been combined with detergent and remaining filth in the textiles during washing phase, goes through the textiles due to centrifuge force towards the walls of the basket (2). Since the basket (2) wall is perforated, the liquid goes through to the tub (1), wherein said liquid is drained (17).

During centrifuge (16), the textiles are adhered to the basket (2) wall, thus textile volume is compacted or compressed. The textile volume compression, favors the spraying step, since it reduces the textile area exposed to spraying, that is, it reduces the textile exterior layer, achieving a better and uniform saturation of fresh water in the textile external layer.

The remaining liquid in the tub (1) is continuously drained (17) by means of the pump (3) and directional valve (8) which is open to the drain (7).

A first semi-rinse block has been finished. Preferably, the number of semi-rinse blocks is greater to one semi-rinse block. More preferably, the number of blocks is greater than two semi-rinses. However, it is more preferable that the number of blocks be greater than three semi-rinse blocks, since detergent removal is done with greater efficacy, as well as filth carrying is done with greater ease.

The electronic control (55) contains a counter, which determines (18) if the number of semi-rinse blocks is equal to that established. If this is not achieved then the basket is stopped (78) again, fresh water is admitted (14), sprayed (15), drained (17) and centrifuged (16) until the counter determines (18) that the number of semi-rinse blocks has been achieved.

If the number of pre-established semi-rinse blocks has been achieved, the final centrifuge (19) is extended a determined time and the process is finished (20).

The quantity of fresh water admitted (14) in each semi-rinse block may vary in predetermined manners, for example, starting with a high quantity of water, and decrement the amount subsequently with each semi-rinse block. Optionally, the same quantity of fresh water may be used in each semi-rinse block. Optionally a low quantity of water may initiate and increment the first quantity with each semi-rinse block. Optionally a first quantity of water higher than a second quantity of water and the same that a third quantity of water may be used. The variations of fresh water quantity to use, will be explained with greater detail ahead. However, it should be noted that the water volume is not adaptive, that is, the water volume does not vary in function of the textile quantity within the basket (2), rather, the quantities and volumes are pre-established by patterns.

It has been noted that with the method of the invention, preferably a low quantity of water is used in each semi-rinse, since a better water saving is achieved, and increments the rinse effectiveness in the textiles.

Figure 10:
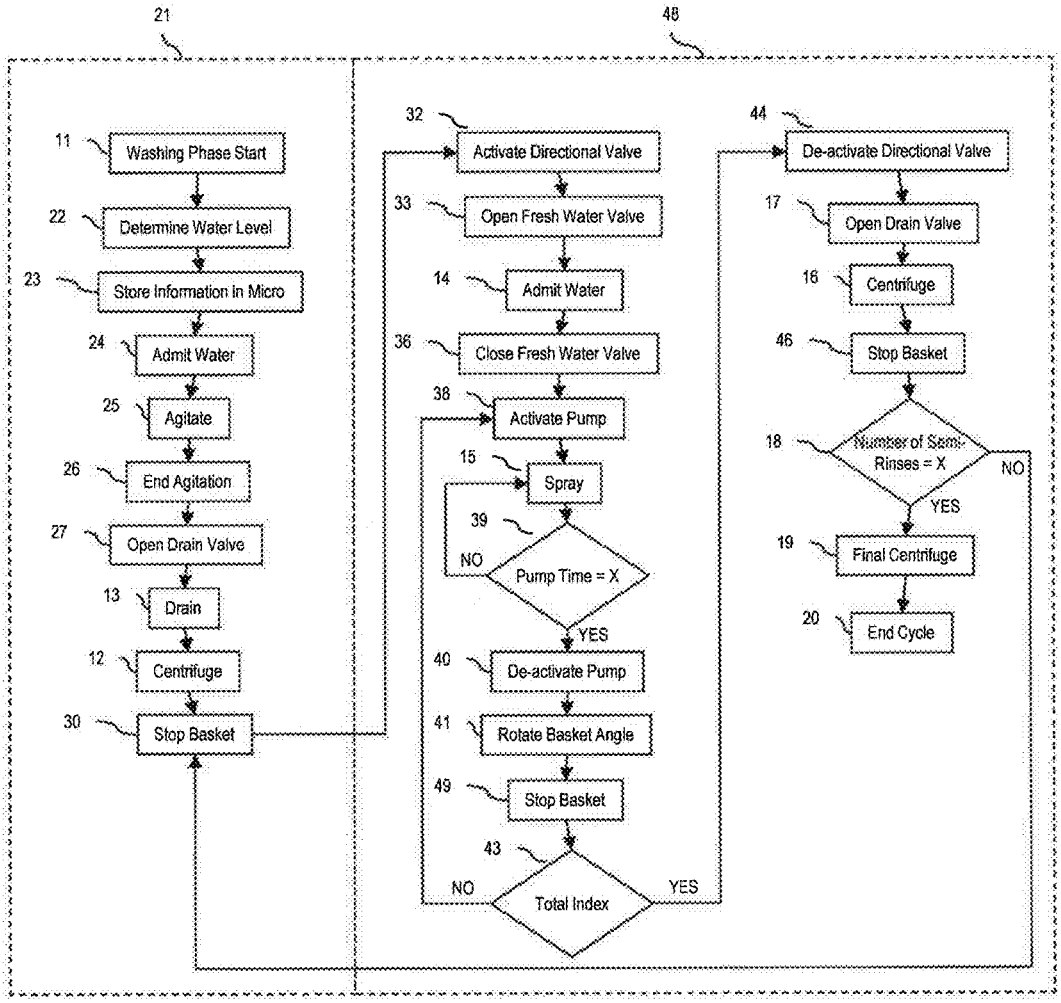
FIG. 10 is a flow diagram of a first embodiment of the rinse phase of the present invention.

FIG. 10 is a flow diagram of a first embodiment of the rinse phase. Washing phase (21) is described in a general manner, whereas rinse phase (48) is described in a detailed manner.

When initiating (11) washing phase (21) water level is determined. Water level may be determined by the user prior to initiating (11) washing phase (21) or may be adaptive by parameter determination using indicative data, such as that known in prior art such as U.S. Pat. No. 6,415,469. Water admission levels may be different, varying from high to minimal.

Once the water level to be used has been determined (22), the information is stored (23) in the electronic control. Water is admitted (24) which is mixed with detergent which will form the liquid in which the textiles will be agitated. After a determined time, agitation is finished (26). The drain valve is opened (27) to drain the liquid. Drain time is a predetermined time, which is controlled by a counter and the electronic control (55). While draining (13), textile centrifuging (12) within the basket (2) is initiated.

Once the determined draining (13) and centrifuging (12) time has finished, the basket (2) is stopped by means of a brake, which may be a brake commonly used in washing machines, such as an electromagnetic brake, or by inertia decrement. The pump (3) is turned off.

When the pump (3) is turned off, rinse phase (48) is started according to the first embodiment of the rinse phase.

Draining is closed (32) by activating the directional valve (8), so that when fresh water is admitted (14) when opening (33) the fresh water valve (4), said water does not drain. Fresh water is admitted (14) while the basket (2) is still and is stored in the tub (1). Preferably fresh water is admitted (14) between the tub (1) and the basket (2).

Fresh water may be admitted by means of a dispenser box (71) or by means of a hose (5) that discharges water between the tub (1) and basket (2).

As was mentioned before, the quantity of fresh water admitted (14) in each semi-rinse block is predetermined and does not vary in an adaptive manner in function of textile load, rather a determined pattern.

Fresh water admission (14) for the semi-rinse block is controlled by a flow sensor (76). Once the flow sensor (76) determines that the required water quantity has been admitted, it sends a signal to the electronic control (55), so that said electronic control (55) sends a signal so that the admission valves (4) are closed (36). If the washing machine includes a pressure sensor (58), during fresh water admission (14) it is determined (35) if water level in the tub (1) has reached a predetermined level. If the determined water level has been achieved, admission valves (4) are closed.

The directional valve (8) is opened towards the conduction hose (6) and the pump (3) is activated (38), allowing way to fresh water through the conduction hose (6).

In a first washing machine embodiment, when activating (38) the pump (3), water goes up the conduction hose (6) until reaching the nozzle (9). The nozzle (9) emits the fresh water with a predetermined speed towards the deflector (10) which directs the fresh water to the textiles within the basket (2), that is, sprays (15) the water to the textiles in the basket (2).

In a second washing machine embodiment, when activating (38) the pump (3), water goes up the conduction hose (6) until reaching the dispenser box (71). Fresh water or the combined liquid with softener is emitted from the dispenser box (71) with speed, from the dispenser box (71) towards the textiles in the basket (2), that is, sprays (15) the water to the textiles in the basket (2).

During spraying (15), the pump is activated (38) by a determined time that is controlled and determined (39) by an electronic control (55) counter.

If it is determined (39) that the time has been achieved, the pump (3) is deactivated (40).

The spraying (15) time is predetermined and constant. The spraying time, depends on the water quantity admitted (14). Therefore, the memory in the electronic control (55) contains a value table, which compares the admitted (14) water quantity versus the time the pump (3) has to be turned on to appropriately spray (15) the textiles. Therefore, pump activation (38) time is a fixed parameter.

Since the basket (2) is still, and by means of the deflector (10) or dispenser box (71), a better fresh water or fresh water with softener hydration and saturation is achieved in the textiles. A rotating basket, as disclosed in prior art, only dehydrates the textiles in the basket. Having the basket (2) still, is especially advantageous to dilute the detergent and carry the filth retained in the textile fiber, since when damping the textile external layers, these are fresh water saturated, considerably diminishing the detergent concentration and improving in a uniform manner filth carrying.

When spraying, the use of a deflector (10) as well as a dispenser box (71), achieves spraying in the form of an inverse fan, thus accomplishing a greater textile spray area. The spray area, is determined by angle $\alpha$, shown in FIG. 1, caused by the deflector (10) or dispenser box (71), and wherein said angle $\alpha$ is preferably between 70° to 110°.

When the pump (3) is turned off, the basket (2) is rotated or indexed (41) in any of the two senses, i.e. clockwise or counter-clockwise. Preferably, the basket (2) is rotated or indexed (41) an angle $\beta$ shown in FIG. 1, which is preferably between 45° to 110°, so that fresh water is sprayed (15) to the textiles and these are uniformly damped and saturated of fresh water.

Angle $\beta$ depends upon angle $\alpha$, since the use of a deflector (10) or dispenser box (71) makes the fresh water being sprayed in the form of an inverse fan, thus creating a certain spraying area. To appropriately spray the textiles, the basket rotation must be in function of $\alpha$, achieving a uniform spraying in all the spraying areas. Additionally, the number of times the basket (2) is rotated or indexed, is also dependent upon $\alpha$. The number of basket (2) rotations or indexations is preferably constant.

When rotating or indexing (41) the basket (2), it is determined if the basket has achieved the range of determined angle $\beta$.

When the basket (2) has reached the next angle $\beta$, the basket (2) is stopped. Once the basket (2) is stopped, it is determined if the number of indexations has been completed. If it is determined (43) that the basket (2) has yet to finish its indexations, the steps of activating (38) the pump, spraying (15), determining (39) pump time, deactivating (40) the pump, rotating (41) basket, determining if the basket is in determined angle range $\beta$ and determining (43) is the basket (2) has completed its indexations, are again carried out.

If the basket (2) has completed its indexations, the directional valve (8) is deactivated (44), to close way to the conduction hose (6) and opening way to the draining hose (59). When draining (17), centrifuge (16) is started by a predetermined time.

When draining (17) and centrifuging (16) time are finished, the basket (2) is stopped (46).

It is determined (18) if the number of semi-rinse blocks is the total of the predetermined semi-rinse blocks. If there exist other semi-rinse blocks, the directional valve (8) is activated, closing the valve towards drain and opening the valve toward spraying, so that all the semi-rinse steps are repeated, that is, the steps of opening (33) the fresh water valve until stopping (46) the basket (2).

If the number of semi-rinse blocks is the predetermined total of semi-rinse blocks, a final centrifuge (19) is carried out, which may be an extension of the centrifuge (16) of the last semi-rinse block, and the process is finished (20).

A first semi-rinse block has been finished. Preferably, the number of semi-rinse blocks is greater to one semi-rinse block. More preferably, the number of blocks is greater than two semi-rinses. However, it is more preferable that the number of blocks be greater than three semi-rinse blocks, since detergent removal is done with greater efficacy, as well as filth carrying is done with greater ease.

Figure 11:
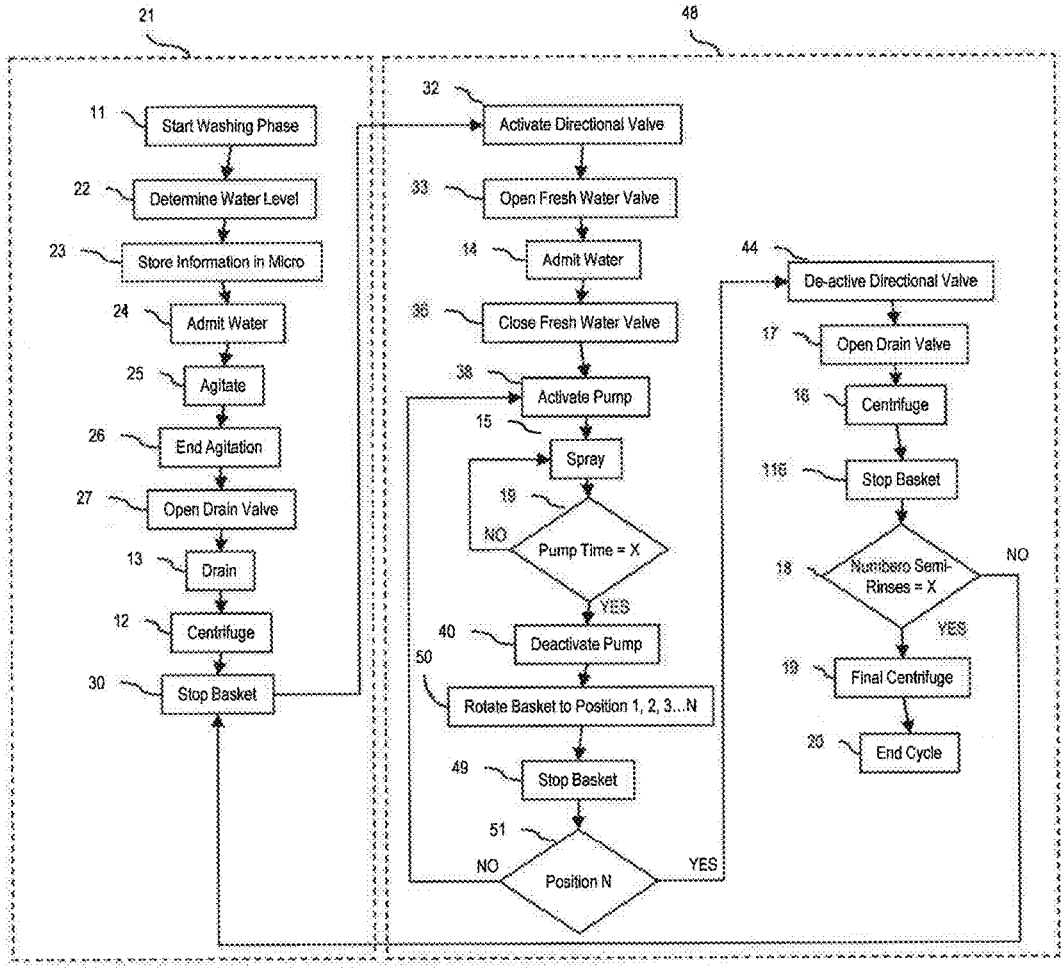
FIG. 11 is a flow diagram of a second embodiment of the rinse phase of the invention.

FIG. 11 is a flow diagram of a second embodiment of the rinse phase. Washing phase (21) is described in a general manner, whereas rinse phase (48) is described in a detailed manner.

When initiating (11) washing phase (21) the steps mentioned for the first embodiment are carried out, that is, determining (22) water level, storing (23) the information in the electronic control (55), admitting (24) fresh water, agitating (25) and finishing (26) agitation. The drain valve is opened (27) to drain the liquid and the textiles are centrifuged (12) for a predetermined time.

Once the determined draining (13) and centrifuging (12) time has finished, the basket (2) is stopped by means of a brake or by inertia decrement. The pump (3) is turned off.

Draining is closed (32) by activating the directional valve (8), so that when fresh water is admitted (14) when opening (33) the fresh water valve (4), said water does not drain. Fresh water is admitted (14) while the basket (2) is still and is stored in the tub (1). Preferably fresh water is admitted (14) between the tub (1) and the basket (2).

Fresh water may be admitted by means of a dispenser box (71) or by means of a hose (5) that discharges water between the tub (1) and basket (2).

Fresh water admission (14) for the semi-rinse block is controlled by a flow sensor (76). Once the flow sensor (76) determines that the required water quantity has been admitted, it sends a signal to the electronic control (55), so that said electronic control (55) sends a signal so that the admission valves (4) are closed (36). If the washing machine includes a pressure sensor (58), during fresh water admission (14) it is determined (35) if water level in the tub (1) has reached a predetermined level. If the determined water level has been achieved, admission valves (4) are closed.

The directional valve (8) is opened towards the conduction hose (6) and the pump (3) is activated (38), allowing way to fresh water through the conduction hose (6).

In a first washing machine embodiment, when activating (38) the pump (3), water goes up the conduction hose (6) until reaching the nozzle (9). The nozzle (9) emits the fresh water with a predetermined speed towards the deflector (10) which directs the fresh water to the textiles within the basket (2), that is, sprays (15) the water to the textiles in the basket (2).

In a second washing machine embodiment, when activating (38) the pump (3), water goes up the conduction hose (6) until reaching the dispenser box (71). Fresh water or the combined liquid with softener is emitted from the dispenser box (71) with speed, from the dispenser box (71) towards the textiles in the basket (2), that is, sprays (15) the water to the textiles in the basket (2).

During spraying (15), the pump is activated (38) by a determined time that is controlled and determined (39) by an electronic control (55) counter.

If it is determined (39) that the time has been achieved, the pump (3) is deactivated (40).

The spraying (15) time is predetermined and constant. The spraying time, depends on the water quantity admitted (14). Therefore, the memory in the electronic control (55) contains a value table, which compares the admitted (14) water quantity versus the time the pump (3) has to be turned on to appropriately spray (15) the textiles. Therefore, pump activation (38) time is a fixed parameter.

Since the basket (2) is still, and by means of the deflector (10) or dispenser box (71), a better fresh water or fresh water with softener hydration and saturation is achieved in the textiles. A rotating basket, as disclosed in prior art, only dehydrates the textiles in the basket. Having the basket (2) still, is especially advantageous to dilute the detergent and carry the filth retained in the textile fiber, since when damping the textile external layers, these are fresh water saturated, considerably diminishing the detergent concentration and improving in a uniform manner filth carrying.

When spraying, the use of a deflector (10) as well as a dispenser box (71), achieves spraying in the form of an inverse fan, thus accomplishing a greater textile spray area. The spray area, is determined by angle $\alpha$ shown in FIG. 1, caused by the deflector (10) or dispenser box (71), and wherein said angle $\alpha$ is preferably between 70° to 110°.

When the pump (3) is turned off, the basket (2) is rotated (50) in any of the two senses, i.e. clockwise or counterclockwise. Preferably, the basket (2) is rotated (50) to predetermined positions by means of the electronic control (55), which indicates to the motor, the drive system (54) and brake, the positions where the basket must be stopped.

The positions are previously determined and stored in the electronic control (55) and are dependant upon angle $\alpha$, additionally the number of positions is also directly dependent upon angle $\alpha$, since the use of a deflector (10) or dispenser box (71) makes the fresh water being sprayed in the form of an inverse fan, thus creating a certain spraying area. To appropriately spray the textiles, the basket rotation must be in function of $\alpha$, achieving a uniform spraying in all the spraying areas.

When the basket (2) has reached the position, the basket (2) is stopped. Once the basket (2) is stopped, it is determined if the number of positions has been completed. If it is determined (43) that the basket (2) has yet to reach the final position, the steps of activating (38) the pump, spraying (15), determining (39) pump time, deactivating (40) the pump, rotating (41) basket, rotating (50) and stopping (49) the basket (2), are again carried out.

If the basket (2) has reached the last position, the directional valve (8) is deactivated (44) to close way to the conduction hose (6) and opening way to the draining hose (59). When draining (17), centrifuge (16) is started by a predetermined time.

When draining (17) and centrifuging (16) time are finished, the basket (2) is stopped (46).

It is determined (18) if the number of semi-rinse blocks is the total of the predetermined semi-rinse blocks. If there exist other semi-rinse blocks, the directional valve (8) is activated, closing the valve towards drain and opening the valve toward spraying, so that all the semi-rinse steps are repeated, that is, the steps of opening (33) the fresh water valve until stopping (46) the basket (2).

If the number of semi-rinse blocks is the predetermined total of semi-rinse blocks, a final centrifuge (19) is carried out, which may be an extension of the centrifuge (16) of the last semi-rinse block, and the process is finished (20).

Preferably, the number of semi-rinse blocks is greater to one semi-rinse block. More preferably, the number of blocks is greater than two semi-rinses. However, it is more preferable that the number of blocks be greater than three semi-rinse blocks, since detergent removal is done with greater efficacy, as well as filth carrying is done with greater ease.

Figure 12:
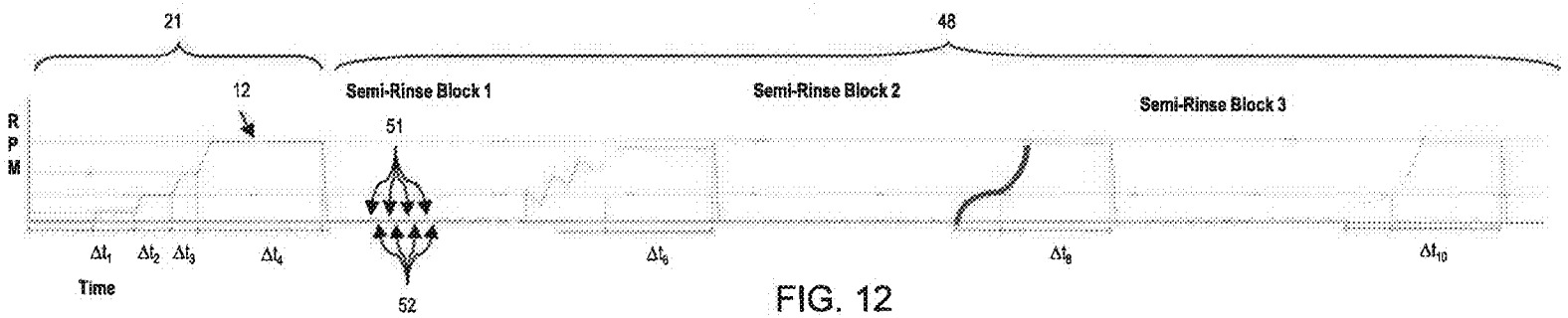
FIG. 12 compares the basket revolutions versus rinse block time of the first and second embodiments of the invention.
Figure 13:
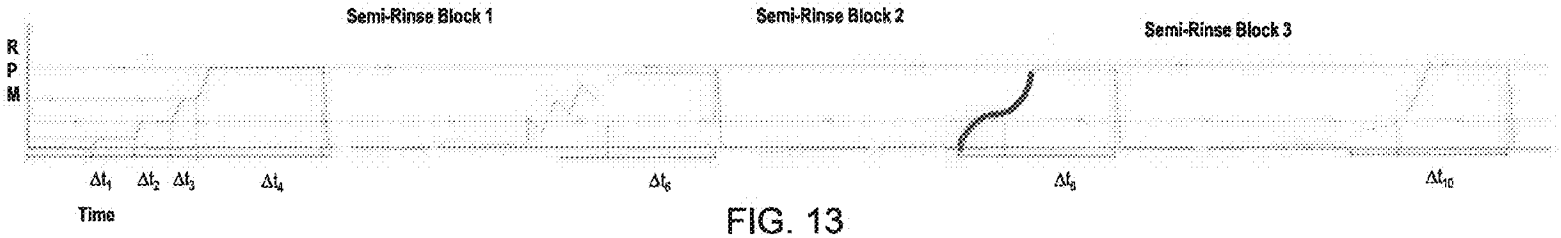
FIG. 13 compares the basket revolutions versus rinse block time of the prior art.

FIG. 12 is a comparative of the basket revolutions in the X axis versus the corresponding times the basket has revolutions in Y axis, during the rinse method of the first and second embodiment of the rinse phase. FIG. 12 may be compared versus FIG. 13, which is also a comparative of the basket revolutions in the X axis versus the corresponding times the basket has revolutions in Y axis, during the prior art rinse. FIGS. 12 and 13 may be compared versus FIG. 14, which is also a comparative of the basket revolutions in the X axis versus the corresponding times the basket has revolutions in Y axis according to the rinse method of the preferred embodiment of the rinse phase.

In FIG. 13, which is a figure of the prior art, the centrifuge of the washing phase is carried out in times $\Delta t_{11}$, $\Delta t_{12}$, $\Delta t_{13}$ and $\Delta t_{14}$ When time $\Delta t_{14}$ finishes, the rinse phase is started, and the motor rotates the basket at a lower speed than the maximum rotation speed, greater however, to null speed. During a predetermined first time, between $\Delta t_{14}$ and $\Delta t_{15}$, a first semi-rinse block is carried out. During this first time, the water coming from the entry valves is being sprayed directly to the textiles within the basket. During this first time, the motor drives the shafts by means of the belts and pulleys, thus rotating in a synchronized manner the agitator or propeller and the basket. When the first semi-rinse block finishes a first centrifuge within the rinse phase (48) is carried out.

The basket (2) is spun at maximum speed during time $\Delta t_{15}$. The above process is repeated until the number of predetermined semi-rinse blocks has been completed.

As seen in FIG. 13, the motor in the prior art does not stop driving the basket, since it constantly rotates the basket.

On the other hand, as seen in FIG. 12, the basket revolutions in the first and second embodiment of the invention is different. That is, a centrifuge (12) of washing phase (21) is done in times $\Delta t_1$, $\Delta t_2$, $\Delta t_3$ and $\Delta t_4$. When finishing time $\Delta t_4$, rinse phase (48) is started. The motor no longer drives the basket (2). The basket (2) is halted by means of a brake or by decrementing inertia and the revolutions peak diminishes until reaching 0. During a first predetermined time, between $\Delta t_4$ and $\Delta t_6$, a first semi-rinse block is carried out. During this first time, water coming from the tub (1) is spraying (15) the textiles within the basket (2). During this first time, the basket is rotated with stops, during which, the motor stops driving the basket.

The necessary revolutions needed to rotate the basket (2) to predetermined positions according to the second embodiment of the rinse phase, or the angle range predetermined according to the first embodiment of the rinse phase, is less than keeping the basket (2) rotating. The afore, may be seen in FIG. 12, between times $\Delta t_4$ and $\Delta t_6$. During this time interval, the basket rotation is being done in the show peaks (51), while the spraying is carried out with null revolutions (52).

When the first semi-rinse block is finished, a first centrifuge of the rinse phase (48) is carried out.

The basket (2) revolutions peak to the maximum for a time $\Delta t_6$. The above process is repeated until the total predetermined semi-rinse blocks have been completed.

It should be clear that the centrifuge ramp may increase speed in different manners, as was stated before, and not exclusively as shown in FIG. 12. The centrifuge step may be different and is not the object of the invention, in an illustrative manner, FIG. 12 shows the different manners in which the centrifuge blocks may be started. For example, in a first block, between times $\Delta t_1$ through $\Delta t_4$ the basket revolutions are in the form of steps. That is, the basket is spun to a maximum speed by means of ascending speed steps. In the first semi-rinse block it is shown that prior to and during $\Delta t_6$ the basket may be sped by means of ascending and descending peaks constantly ascending until reaching a maximum speed. In the second semi-rinse block, it is shown that prior to and during $\Delta t_8$ the basket rotation speed ascends in curve, and later maintains the rotation speed for a determined time and later ascends the basket rotation speed again until reaching a top speed. In the third semi-rinse block it is shown that prior to and during $\Delta t_{10}$ the basket rotation speed is elevated in a straight ascending manner and later the rotation speed is kept at a determined time and is later ascended in a curved manner until reaching maximum speed.

Additionally, in a less preferred manner, the semi-rinse blocks of the prior art in FIG. 13 it is shown that the rotation speed in times $\Delta t_{15}$, $\Delta t_{16}$ and $\Delta t_{17}$, ascends in a constant straight manner.

Ascending the basket rotation speed in a non-straight manner, that is, with small steps during the ascent, allows controlling the suds generated by the soap. The suds of the soap tend to ascend, and therefore, while draining, the suds between the tub (1) and the basket (2) is constantly ascending. If the suds touch the basket (2) which is rotating at high speed, the suds generation grows exponentially. The afore creates a friction force that is directly proportional to the suds quantity between the tub (1) and the basket (2) in a given time. At this time, the basket (2) rotation velocity is in function of the drive given by the motor and the friction force created by suds generation may be greater that the drive driven by the motor, and thus, may stop the basket (2). Therefore, it is important to ascend the basket rotation revolutions in an indirect manner, allowing suds control.

Figure 14:
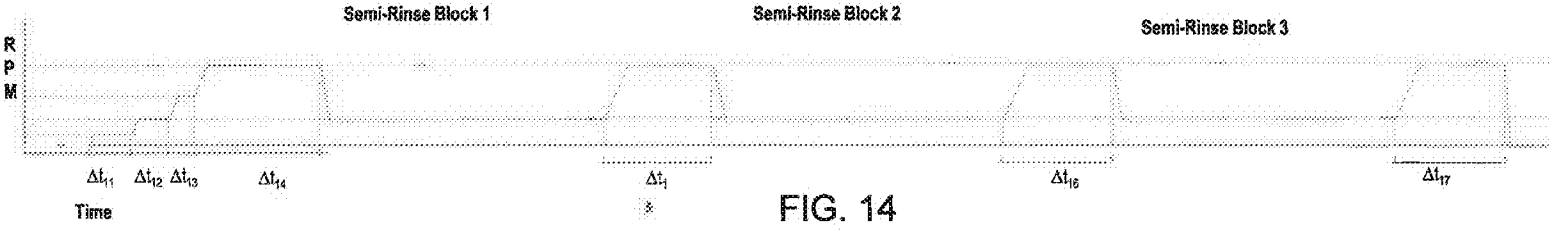
FIG. 14 Prior Art
FIG. 14 compares the basket revolutions versus rinse block time of the preferred embodiment of the invention.

In regards to the first embodiment of the rinse phase and according to FIG. 14, said embodiment simply contains pure null (51) revolutions between times $\Delta t_4$ and $\Delta t_6$. Therefore, the energy used in the first embodiment is lower than the first and second rinse phase embodiments, as well as a lower energy use than the prior art.

Figure 15:
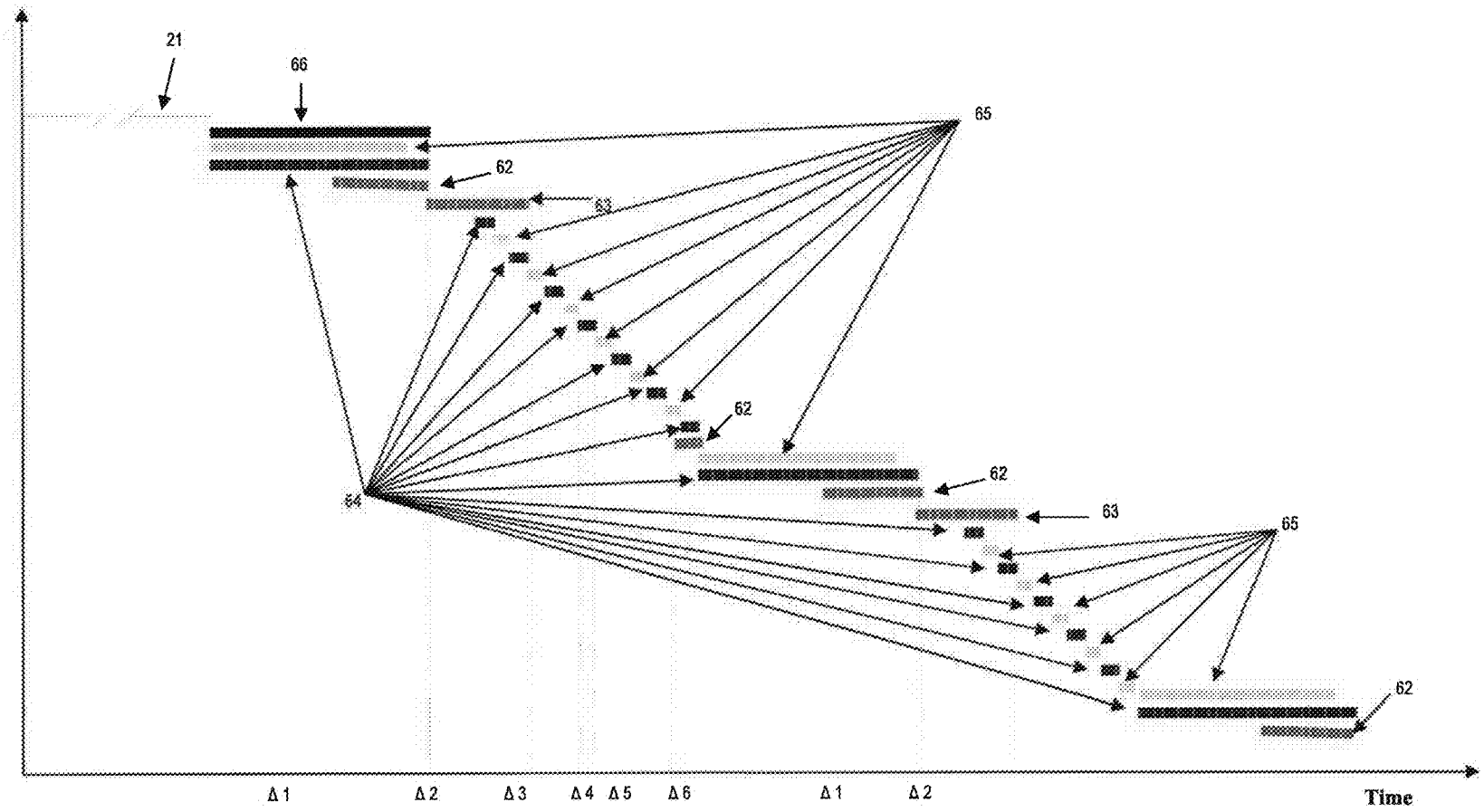
FIG. 15 is a time table of the first and second rinse phase embodiments of the invention.

FIG. 15 shows a time diagram of the first and second rinse phase embodiments. When washing phase (21) finishes, draining and centrifuging (66) are started, to remove the remaining liquid in the textiles and tub (1) during washing phase (21). During time Δ1, the pump (64) and motor (65) are activated. Time Δ1, is a fixed time and is not adaptive, as explained earlier. Closer to the termination of said time Δ1, the directional valve (62) starts changing direction towards the conduction hose (6). That is, the drain output starts to close, and the output to the conduction hose (6) starts to open. The motor conduction process is finished starting time Δ2, which finishes prior to the other processes. The centrifuge (66), pump (64) and opening/closing of directional valve (62) processes, finish at the same time when times Δ1 and Δ2 finish.

The admission valve is activated, and a flow sensor (76) measures (63) the incoming water quantity. The process may finish when the pressure sensor (58) indicates that the water level has reached the predetermined level for the process. The afore finishes in a time Δ3. Optionally, the spraying may be done during the filling of the tub, and therefore the flow sensor (76) may also indicate the incoming water quantity, measuring that that is the predetermined quantity, and thus the pressure sensor (58) is not necessary, however, for security reasons the pressure sensor (58) may be kept.

During times Δ4 and Δ5 the spraying pump (64) and the motor (65) are constantly being activated and deactivated. When the pump is activated, water is lead through the conduction hose, reaching the nozzle and crashing against the deflector according to the first washing machine embodiment and the dispenser box (71) according to the second washing machine embodiment, and therefore spraying textiles saturating them uniformly. Finishing time Δ4 the motor is activated for a time Δ5, driving the basket (2), rotating to a certain angle or indexing said basket to a predetermined position.

The above mentioned process is carried out until the first semi-rinse block has been completed, that is, until the angle rotations or the predetermined positions have been completed, until a time Δ6. Before finishing the last pumping of the block (64), the directional valve again shifts (62) to an open position towards the draining and closed towards the conduction hose.

The motor (65) is again activated to carry out a basket centrifuge pattern, as well as activating the pump (64) to drain the remaining liquid of the carried out centrifuge block.

A new centrifuge block is started, repeating the steps, that is, during time Δ1 the pump (64) and motor (65) are activated. Time Δ1 is a fixed time and is non-adaptive as explained earlier. During time Δ1, close to finishing said time Δ1, the directional valve (62) starts to shift. That is, the drain exit closes and the conduction hose exit is opened. The motor conduction process finishes starting time Δ2, which finishes prior to the other processes. The centrifuge (66), pump (64) and opening/closing of the directional valve (62) processes finish at the same time that times Δ1 and Δ2.

The processes are repeated until the number of semi-rinse blocks have been completed.

Figure 16:
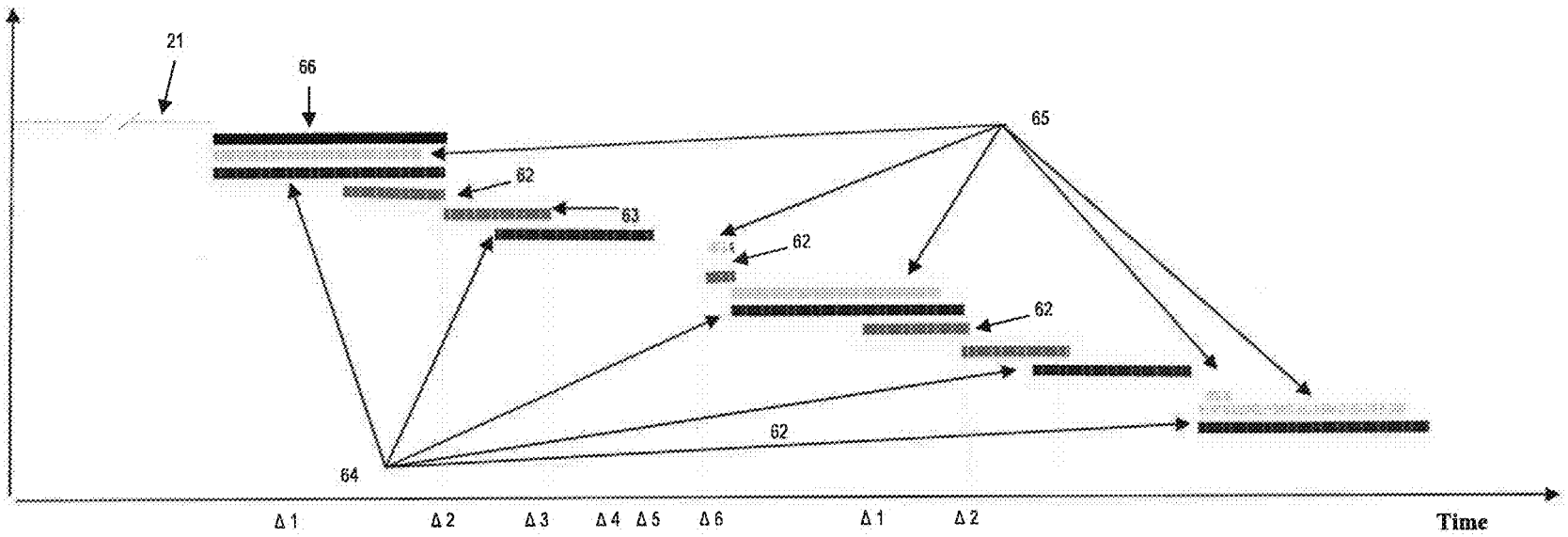
FIG. 16 is a time table of the preferred rinse phase embodiment of the invention.

In the preferred embodiment of rinse with the preferred embodiment of the washing machine, the motor (65) is not activated during time Δ2 starting time Δ6 and the pump (64) is active during times Δ2 through Δ6, as shown in FIG. 16.

Figure 17:
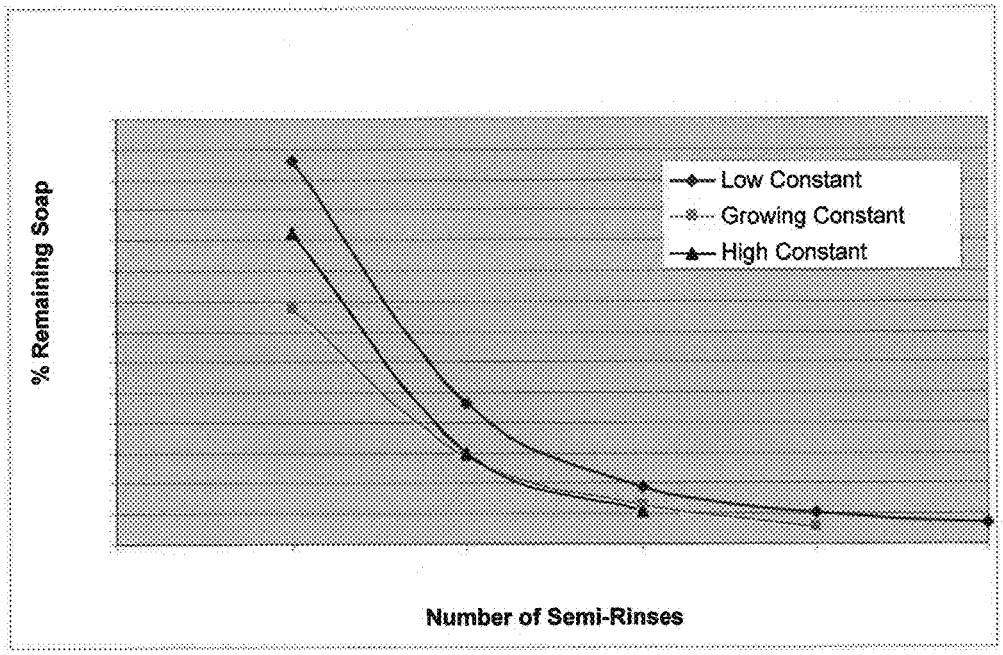
FIG. 17 is a water usage graph showing measured rinse efficiency versus a number of semi-rinse blocks (or cycles) performed using different water levels.

FIG. 17 shows the efficiency of the rinse methods of the invention by means of remaining soap percentage in the textiles versus the number of semi-rinse blocks. As shown in the figure, the preferred quantity of fresh water are constant and low levels, as was mentioned before.

The quantity of water to admit (14) may vary, for example, starting with a high amount of fresh water and decrease the first amount of fresh water with each subsequent semi-rinse, as is shown with the curved line with square bullets of FIG. 17. The same high water quantity may also be used in each semi-rinse, as shown in the curved line with triangular bullets of FIG. 17. However, preferably, a low fresh water quantity is sued in each semi-rinse block, since a significant water saving may be achieved, also increasing the effectiveness of the textile rinse, as is shown with the curved line with diamond bullets of FIG. 17.

However, the above manners for water quantities to be used in the in the semi-rinse blocks, even when constant between themselves, i.e. follow a certain water volume pattern, are not the only patterns that may be followed.

For example, a first water pattern embodiment is that all the blocks admit the same water volume. Therefore, the spraying time and number of indexations are same.

A further water pattern embodiment, is that the water volume admitted in the first block is greater than the water volume admitted in the second block and the water volume of the second block is the same as the water volume admitted for the third block. A further embodiment is wherein the water volume of the first block is greater than the water volume for the second block, and the water volume of the second block is greater than the water volume of the third block. A further embodiment is when the water volume of the first block is greater than the second block, and wherein the water volume of the third block is greater then the second block. A further embodiment is when the water volume of the second block is greater than the first and third blocks respectively.

Additionally, the time in each semi-rinse block, further to being constant, is also in function of the admitted water volume, however it is noted that the time is not adaptive, rather by means of a table in the electronic control (55), the block time may be determined, the number of indexations or the basket positions, the spraying time, etc.

Alterations of the structure disclosed in the specification, may be provided by those skilled in the art. However, it must be understood that the specification relates to the preferred embodiments of the invention, which is for illustrative purposes only, and should not be construed as a limitation of the invention. All modifications that do not depart from the spirit of the invention will be included in the scope of the enclosed claims.

The invention claimed is:

1. A textile rinsing method in a vertical axis washing machine having a washing tub with a tub bottom, a perforated basket, wherein the basket perforations allow fluid communication between an interior of the basket and the washing tub; a driving system including a motor, pulleys, bands and shafts, to rotate the basket; an admission valve, a conduction hose placed outside the washing tub, a discharging device disposed between the basket and a tub cover; a directional valve, a pump and an electronic control having a counter; said method comprising performing a pre-established number of semi-rinse blocks, wherein a semi-rinse block from said pre-established number of semi-rinse blocks comprises the following steps:

a) activating the water admission valve to admit a predetermined amount of fresh water between the tub and the basket while the basket is still to avoid contacting directly textiles;

b) determining if a predetermined amount of fresh water has been admitted;

c) once the predetermined amount of fresh water is admitted, sending a signal to the electronic control to close the admission valve and opening the directional valve shifting flow towards the conduction hose;

d) activating the pump to lead the fresh water from the tub bottom through the conduction hose to the discharging device comprising a nozzle and a deflector;

e) emitting said fresh water from the nozzle to crash it against the deflector to spray the textiles within the basket within a spray area determined by an angle α, which is between 70° to 110°;

f) spraying the textiles for a time predetermined by the electronic control, g) once the spraying time has elapsed, turning off the pump, h) rotating or indexing the basket a β angle which is between 45° to 110°, angle β depends upon angle α to achieve a uniform spraying in the spraying area determined by angle α i) stopping the basket once it reaches a β angle such that the electronic control determines if further rotations or indexations are needed; if further rotations or indexations are needed steps d) to h) are repeated such that fresh water is sprayed to the textiles and these are uniformly damped and saturated of fresh water, the basket rotations or indexations depends on angle α;

j) if the electronic control determines that the basket has completed its rotations, deactivating the directional valve to close way to the conduction hose and opening way towards a drain by means of a draining hose to drain the liquid from the tub bottom;

k) when draining, centrifuge (16) is started by a predetermined time;

l) stopping the basket once the draining and centrifuging steps are finished.

2. The method of claim 1, wherein the counter of the electronic control determines if the pre-established number of semi-rinse blocks has been achieved.

3. The method of claim 2, wherein if the pre-established number of semi-rinse blocks has been achieved, a final centrifuge is extended a determined time and the semi-rinse block steps are finished; wherein if the pre-established number of semi-rinse blocks has not been achieved, steps a) to l) are repeated until the counter of the electronic control determines that the number of semi-rinse blocks has been achieved.

4. The method of claim 1, wherein the electronic control provides a signal for all the semi-rinse blocks admitting the same water volume.

5. The method of claim 1, wherein the electronic control provides a signal for each semi-rinse block admitting pre-established different amounts of water.

6. The method of claim 1, wherein the electronic control is configured to store a data table including the spraying time based on the predetermined quantity of fresh water admitted between the tub and the basket.

7. The method of claim 1, wherein the pre-established number of semi-blocks is greater than one semi-rinse block.

8. The method of claim 1, wherein the pre-established number of semi-blocks is greater than two semi-rinse blocks.

9. The method of claim 1, wherein the pre-established number of semi-blocks is greater than three semi-rinse blocks.

10. The method of claim 1, wherein the flow of the directional valve is shifted by an actuator and a fresh water hose is subject to a harness of the washing machine.

11. The method of claim 1, wherein during centrifuge a remaining liquid in the tub is continuously drained by means of the pump and the directional valve which is open to the drain.

12. The method of claim 1, wherein softeners and detergents may be dispatched during different stages of the rinse method by means of a dispatcher located in an upper part of the washing machine, to be guided to the bottom of the tub, without having contact with the textiles, combining with the previously admitted fresh water, creating a rinse liquid.

13. The method of claim 1, wherein the predetermined amount of water admitted is measured by a pressure sensor.

14. The method of claim 1, wherein the predetermined amount of water admitted is measured by a flow sensor.

15. A textile rinsing method in a vertical axis washing machine having a washing tub with a tub bottom, a perforated basket wherein the basket perforations allow fluid communication between an interior of the basket and the washing tub; a driving system including a motor, pulleys, bands and shafts to rotate the basket; an admission valve, a conduction hose placed outside the washing tub, a dispenser box disposed between the basket and a tub cover including at least one water entry, a series of electrical connections, a plurality of ducts and a plurality of holes; a directional valve; a pump and an electronic control having a counter; said method comprising performing a pre-established number of semi-rinse blocks, wherein a semi-rinse block from said pre-established number of semi-rinse blocks comprises the following steps:

a) activating the water admission valve to admit a predetermined amount of fresh water between the tub (1) and the basket (2) while the basket is still to avoid contacting directly textiles;

b) determining if the predetermined amount of fresh water is accumulated in the tub;

c) once the predetermined amount of fresh water is admitted, sending a signal to the electronic control to close the admission valve and opening the directional valve shifting flow towards the conduction hose;

d) activating the pump to lead the fresh water from the tub bottom through the conduction hose to the dispenser box, the plurality of ducts of the dispenser box lead the fresh water to the plurality of holes to be dispensed towards the textiles in the basket;

e) spraying the textiles within a spray area determined by an angle $\alpha$ which is between 70° to 110°, the electrical connections of the dispenser box receive and send signals from the electronic control to determine when to start and finish receiving and emitting water during a spraying phase f) spraying the textiles for a time predetermined by the electronic control, g) once the spraying time has elapsed, turning off the pump, h) rotating or indexing the basket a $\beta$ angle which is between 45° to 110°, angle $\beta$ depends upon angle $\alpha$ to achieve a uniform spraying in the spraying area determined by angle $\alpha$;

i) stopping the basket once it reaches an $\beta$ angle such that the electronic control determines if further rotations or indexations are needed; if further rotations or indexations are needed steps d) to h) are repeated such that fresh water is sprayed to the textiles and these are uniformly damped and saturated of fresh water, the basket rotations or indexations depends on angle $\alpha$;

j) if the electronic control determines that the basket has completed its rotations, deactivating the directional valve to close way to the conduction hose and opening way towards a draining hose to drain the liquid from the tub bottom;

k) when draining, centrifuge (16) is started by a predetermined time;

l) stopping the basket once the draining and centrifuging steps are finished.

16. The method of claim 15, wherein the counter of the electronic control determines if the pre-established number of semi-rinse blocks has been achieved.

17. The method of claim 16, wherein if the pre-established number of semi-rinse blocks has been achieved, a final centrifuge is extended a determined time and the semi-rinse block steps are finished; wherein if the pre-established number of semi-rinse blocks has not been achieved, steps a) to l) are repeated until the counter of the electronic control determines that the number of semi-rinse blocks has been achieved.

18. The method of claim 16, wherein detergents or softeners or chlorines may be kept throughout the dispenser box ducts, which may be mixed throughout the dispenser box ducts with fresh water.

19. A textile rinsing method in a vertical axis washing machine having a washing tub with a tub bottom, a perforated basket wherein the basket perforations allow fluid communication between an interior of the basket and the washing tub; a driving system including a motor, pulleys, bands and shafts to rotate the basket; an admission valve, a conduction hose placed outside the washing tub, a directional valve, a pump and an electronic control having a counter; said method comprising performing a pre-established number of semi-rinse blocks, wherein a semi-rinse block from said pre-established number of semi-rinse blocks comprises the following steps:

a) activating the water admission valve to admit a predetermined amount of fresh water between the tub (1) and the basket (2) while the basket is still to avoid contacting directly textiles;

b) determining if the predetermined amount of fresh water is accumulated in the tub;

c) once the predetermined amount of fresh water is admitted, sending a signal to the electronic control to close the admission valve and opening the directional valve shifting flow towards the conduction hose;

d) activating the pump to lead the fresh water from the tub bottom through the conduction hose to leading the fresh water to a hose with a plurality of holes disposed between the basket and a tub cover, wherein the hose with a plurality of holes (69) is capable of dispensing detergents or chlorines or softeners and is capable of combining fresh water with the detergents or chlorines or softeners;

e) spraying the textiles for a time predetermined by the electronic control, f) once the spraying time has elapsed, turning off the pump, g) deactivating the directional valve to close way to the conduction hose and opening way towards a draining hose to drain the liquid from the tub bottom;

h) when draining, start rotating the basket to centrifuge (16) for a predetermined time;

i) stopping the basket once the draining and centrifuging steps are finished.

* * * * *